US005497688A

United States Patent [19]

Ruiz-Carrero

[11] Patent Number: 5,497,688

[45] Date of Patent: Mar. 12, 1996

[54] MUSICAL INSTRUMENT

[76] Inventor: Candido Ruiz-Carrero, Calle Flamboyan #297 Bo. Esperanza, Vieques, Puerto Rico 00765

[21] Appl. No.: 377,353

[22] Filed: Jan. 24, 1995

[51] Int. Cl.[6] ..... G10D 3/00

[52] U.S. Cl. ..... 84/291; 84/297 R

[58] Field of Search ..... 84/267, 275, 291, 84/297 R

[56] References Cited

U.S. PATENT DOCUMENTS

| | | | |
|---|---|---|---|
| D. 279,102 | 3/1985 | Holmes | D17/20 |
| D. 281,700 | 12/1985 | Egnatski | D17/19 |
| D. 286,299 | 10/1986 | Peavey | D17/14 |
| D. 305,773 | 1/1990 | Young | D17/18 |
| D. 339,150 | 9/1993 | Robertson | D17/14 |
| 4,580,480 | 4/1986 | Turner | 84/1.14 |

*Primary Examiner*—Patrick J. Stanzione
*Attorney, Agent, or Firm*—David L. Baker; Henry S. Miller; Rhodes & Ascolillo

[57] ABSTRACT

A musical instrument having a body and a neck that is fixedly attached to the body. There is a plurality of strings with each string having a first end and a second end. The first end of each string is releasably attachable to the body in at least one of four replaceable string configurations. The second end of each string is releasably attachable to the neck in at least one of four replaceable string configurations. The first replaceable string configuration allows a musician to play a plurality of chords using only one finger. The second, third and fourth replaceable string configurations allow a musician to play the instrument as a six string guitar, a twelve string guitar and a ten string Puerto Rican Cuatro, respectively.

7 Claims, 8 Drawing Sheets

FIG. 3
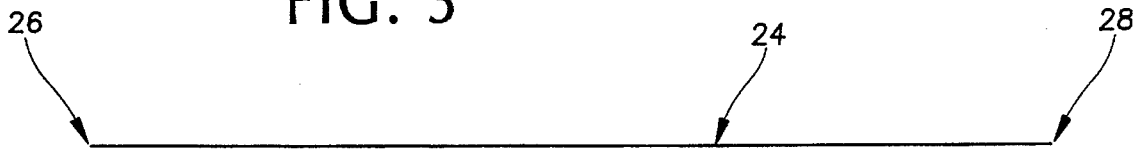
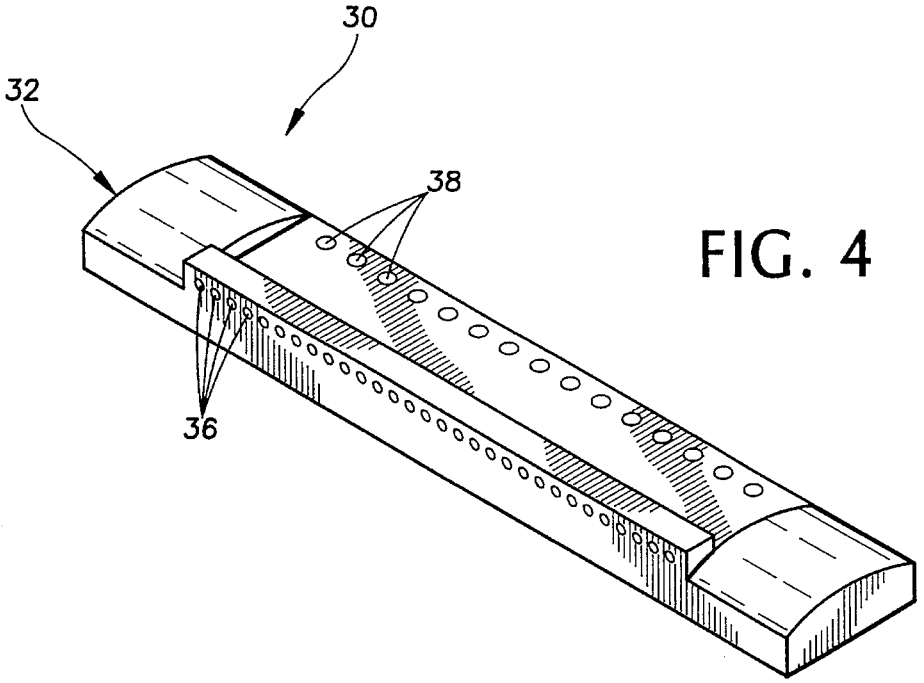
FIG. 4
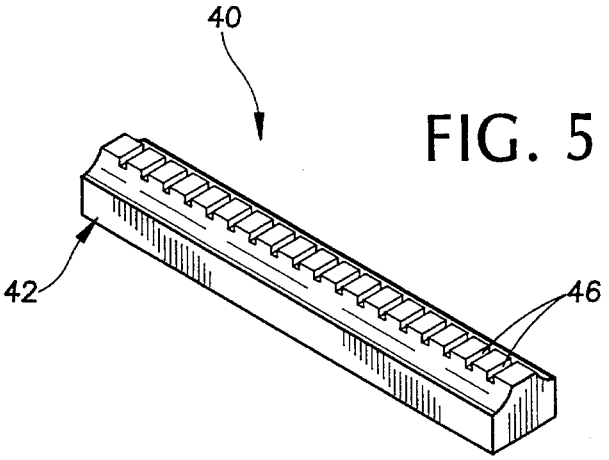
FIG. 5

MUSICAL INSTRUMENT

BACKGROUND OF THE INVENTION

1. Field of the Invention

The present invention relates generally to musical instruments and is particularly directed to a new and improved stringed instrument that may be strung and restrung with any one of four different string configurations. The string configuration used at any given moment depends on the needs of the musician.

2. Description of the Prior Art

Several patents disclose improvements and innovations in the field of musical instruments, in particular guitars. However, most of these improvements relate to the ornamental and decorative aspects of the guitar body. None of the inventions adequately address the problems faced by Applicant. For example, U.S. Patent Design No. 279,102. issued Jun. 4, 1985 to Holmes, discloses a Guitar Body having a unique shape. U.S. Patent Design No. 281,700, issued Dec. 10, 1985 to Egnatski, also discloses a design for a guitar, as does U.S. Patent Design No. 286,299, issued Oct. 21, 1986 to Peavey. U.S. Patent Design No. 305,733, issued Oct. 21, 1986 to Peavey, discloses yet another design for a guitar body.

Also of interest to Applicant is U.S. Pat. No. 4,580,480, issued Apr. 8, 1986 to Turner. Turner teaches an apparatus for controlling signals produced by a transducer carried by an acoustic guitar.

None of these inventions adequately address the issues facing a musician who desires an instrument that may be restrung with different string configurations. Nor do the inventions address the issues facing a novice musician who desires to play an instrument, yet for whatever reason is unable to use the appropriate fingerings to produce the desired chords on a guitar.

SUMMARY OF THE INVENTION

It is well known that many people derive considerable pleasure from playing a musical instrument, in particular a guitar. In the past, two factors have limited the number of people who may enjoy this form of recreation. The first is the cost of the instrument. To a large extent, the type of guitar purchased by a particular musician is dictated by the type of music the musician wishes to play. For example, certain types of music are best played on a six string guitar. In other cases a twelve string guitar is a more suitable instrument. In still other cases a specialty instrument, such as the ten stringed Puerto Rican Cuatro, is necessary. In the past it has been necessary to purchase each of these instrument separately, which drastically increases the musician's costs. As musicians are notoriously undercapitalized, it is easy to understand why many must make due with one instrument instead of the several that they would prefer to own.

The second limiting factor is the difficulty many people experience learning to play the guitar. A novice musician quickly discovers that learning to play the guitar is a demanding task that can take years to master. The basic construction of a guitar, as well as the method by which it is played, are well known. Generally, a guitar has a resonating body with a sounding port. An elongated neck is attached to the resonating body, as is a bridge. A plurality of tuning pegs are attached to the distal end of the neck. A number of strings are attached to the bridge and the tuning pegs.

Of particular interest to Applicant are the strings. In general, these strings are metallic or nylon strings of varying diameters, although other materials are occasionally used. Typically, a finger of the musician's right hand moves across the strings in the area of the sounding port, lightly and selectively striking the appropriate strings. This motion causes the strings to vibrate and produce tones at specific pitches. The pitch produced by a given string is dependant on the string diameter, the tension on the string and the length of the vibrating portion of the string.

The diameter of a particular string is not variable. It is determined by the type of string the musician chooses to use on the guitar. Typically, strings of several diameters are attached to a guitar, thereby producing several different pitches when the strings are struck.

The tension of a string may be varied by adjusting the tuning peg to which the string is attached. Increasing or decreasing tension using a tuning peg allows a musician to fine tune the pitch produced by a given string. In this way the inherent variations between strings of a given diameter can be removed, thereby assuring that a uniform pitch is produced.

Pitches can be also be varied by repositioning the fingers of the left hand on the neck of the instrument so as to change the length of the vibrating portion of the strings. The shorter the vibrating string, the higher the pitch. Over the years certain finger positions have been found to produce a melodious combination of pitches. These combinations of pitches are referred to as chords, while the specific positioning of the fingers required to produce a given chord is referred to as a "fingering". A fingering requires that each finger of the musician's left hand be placed in a specific position on a specific string. When using a conventional guitar it is generally not possible to use one finger to change the length of more than one string.

One of the greatest hurdles a novice musician must overcome is learning the correct fingering for each chord. Furthermore, moving from one chord to another requires the musician to change fingerings quickly and cleanly so as to avoid unintentional and potentially unpleasant chords. Unfortunately, many people who would otherwise enjoy playing a guitar decide that they lack either the time or the dexterity to master the necessary fingerings. For that reason, they abandon their attempt to learn to play the guitar.

In one aspect of the invention there is a new, novel and nonobvious musical instrument featuring a body and a neck fixedly attached to the body. There are a plurality of strings with each string having a first end and a second end. The first end of each string is releasably attachable to the body in at least one of four replaceable string configurations. The second end of each string is releasably attachable to the neck in at least one of four replaceable string configurations.

The first replaceable string configuration consists of eleven strings divided between a first portion and a second portion. The first portion consists of five strings tuned to an A-minor chord. The second portion consists of six strings, five of which are tuned to an E-Major chord. The sixth string of the second portion is tuned to E7. The first replaceable string configuration allows a user to play a plurality of chords using one finger.

The musical instrument also teaches a second, third and fourth replaceable string configuration. The second replaceable string configuration features six strings arranged and tuned so as to allow the musical instrument to be played as a six string guitar. The third replaceable string configuration features twelve strings arranged and tuned so as to allow the musical instrument to be played as a twelve string guitar. The fourth replaceable string configuration teaches ten strings arranged and tuned so as to allow the musical instrument to be played as a ten string Puerto Rican Cuatro.

Another aspect of the present invention describes a new, novel and nonobvious musical instrument. The musical instrument features a resonating body and a neck that is fixedly attached on a proximal end of the neck to the resonating body. There are a plurality of strings. Each string in the plurality of strings has a first end and a second end. There is a means for attaching fixedly attached to an upper surface of the resonating body. This means for attaching comprises a bridge member. The bridge member has a plurality of throughbored string receiving apertures and a plurality of string attachment points. The string attachment points secure the first end of each string. There is a bone bar member that serves as a means for spacing the attached strings. The bone bar member is a rectangular member having a plurality of string channels. The bone bar member is fixedly attached near a distal end of the neck. There is also a means for attaching that attaches the second end of each string to the distal end of the neck and further serves as a means for selectively tuning each attached string. The means for tuning comprises a strings tuning peg mounting member and a plurality of string tuning pegs rotatably mounted therein. The string tuning peg mounting member is fixedly attached to a distal end of the neck. The arrangement of components described herein resembles a guitar in overall appearance.

Each string in the plurality of strings may be attached to both the bridge member and the string tuning pegs in at least one of four replaceable string configurations.

The first replaceable string configuration of the four replaceable string configurations has eleven strings. The eleven strings are divided between a first and second portion. The first portion comprises five strings tuned to an open A-minor chord. The second portion consists of six strings. Five of the six strings in the second portion are tuned to an open E-major chord. The sixth string in the second portion is tuned to E7.

The first configuration allows a musician to play a great variety of chords using only one finger on the neck of the instrument. To do so, the musician simply selects which portion will be used to play the desired chord, changes the length of each string in the selected portion by placing one finger across all the strings in the portion and plays the chord by striking the selected strings with a finger of the right hand.

The second replaceable string configuration comprises six strings tuned to allow a user to play the musical instrument as a six string guitar.

The third replaceable string configuration comprises twelve strings tuned to allow a user to play the musical instrument as a twelve string guitar.

The fourth replaceable string configuration comprises ten strings tuned to allow a user to play the musical instrument as a Cuatro. A Cuatro is a Puerto Rican guitar particularly suited to playing Latin American music.

When the present invention is strung as a six, twelve or ten string guitar, it plays and sounds essentially identical to the guitar it is emulating. This allows a musician to play a greater variety of musical genres than would otherwise be possible with a single instrument.

The musical instrument features a first sounding port and a second sounding port. Both sounding ports extend through the upper surface of the resonating body.

The musical instrument also features a plurality of frets disposed on the neck. The frets are disposed substantially orthogonal to a longitudinal axis of the neck.

It is therefore a principal object of this invention to provide a musical instrument whose strings may be arranged on the instrument in at least one of four string configurations.

It is a second object of this invention that one of the four string configurations allow a novice musician to produce a plurality of chords using one finger of the left hand, thereby eliminating the need for complex and difficult fingerings.

It is a third object of the invention that the remaining string configurations allow a musician to play the instrument as if the instrument were a six string guitar, a twelve string guitar, and a Puerto Rican ten string guitar, also known as a Cuatro.

It is a fourth object of the invention that it resemble a guitar in tone and appearance.

BRIEF DESCRIPTION OF THE DRAWINGS

FIG. 3 is a left side elevational view of a string.

FIG. 4 is a perspective view of the bridge member.

FIG. 5 is a perspective view of the bone bar member.

DETAILED DESCRIPTION OF THE PREFERRED EMBODIMENT

Figure 1:
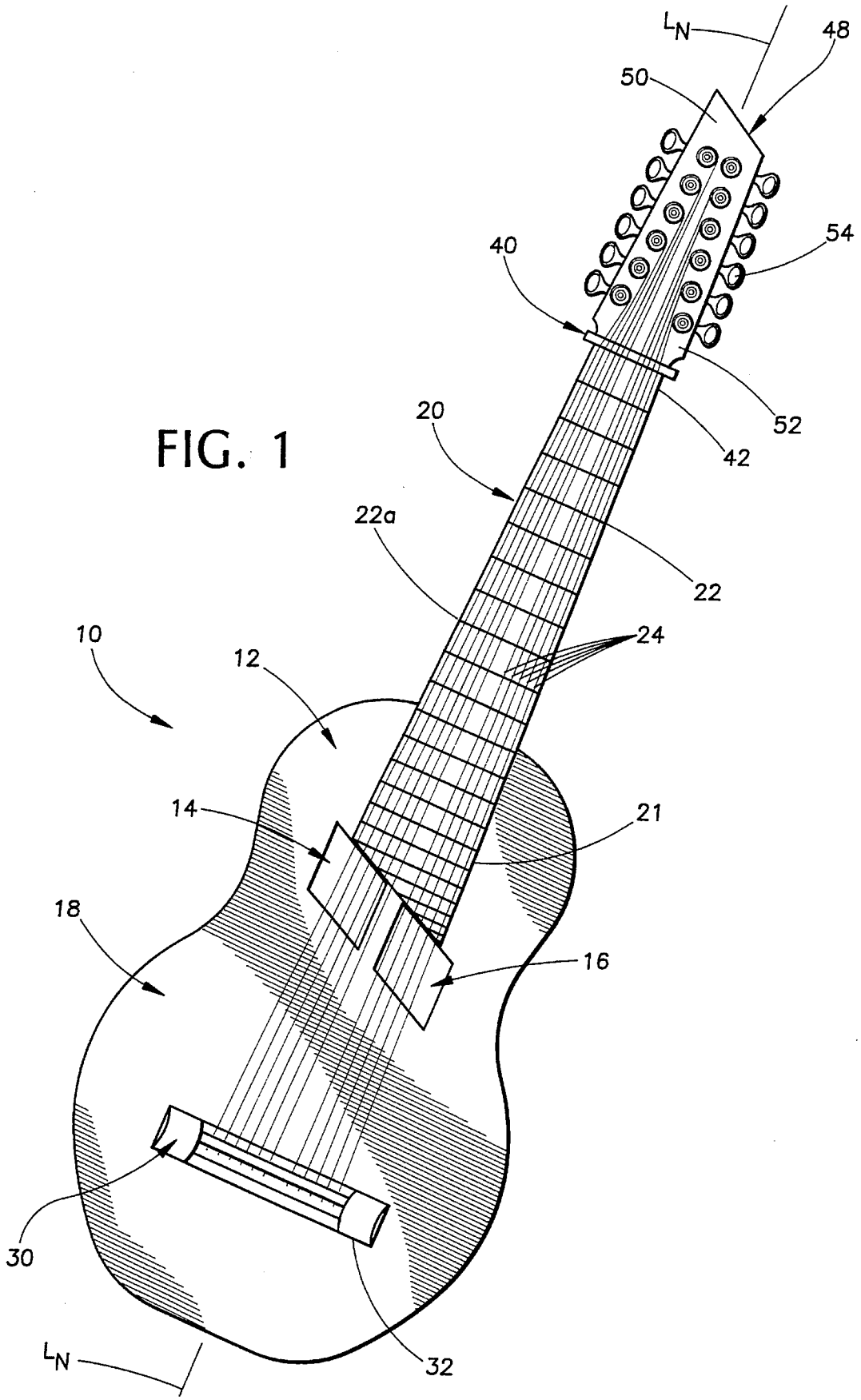
FIG. 1 is a top plan view of the musical instrument.
Figure 2:
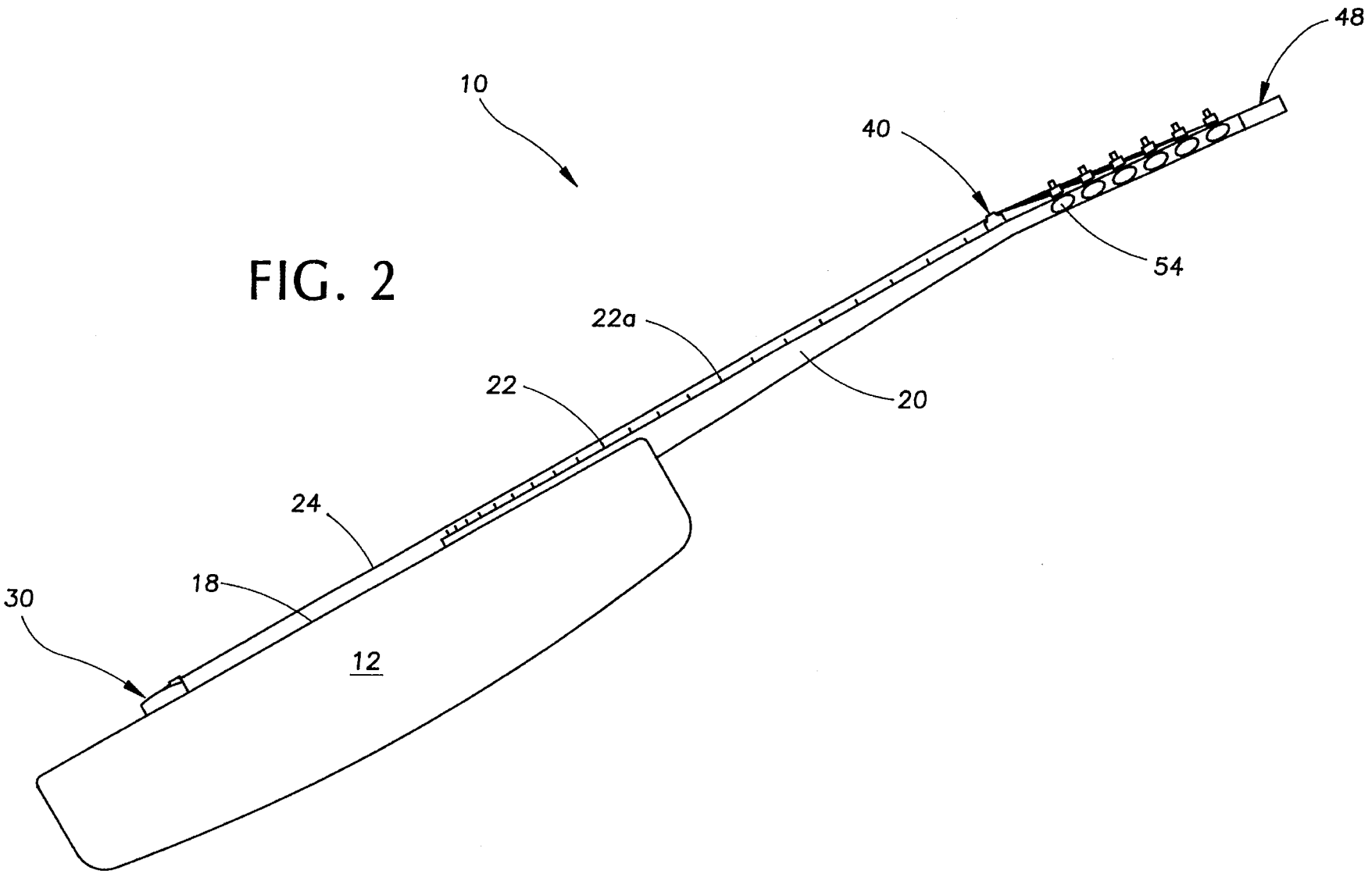
FIG. 2 is a left side elevational view of the musical instrument.
Figure 6:
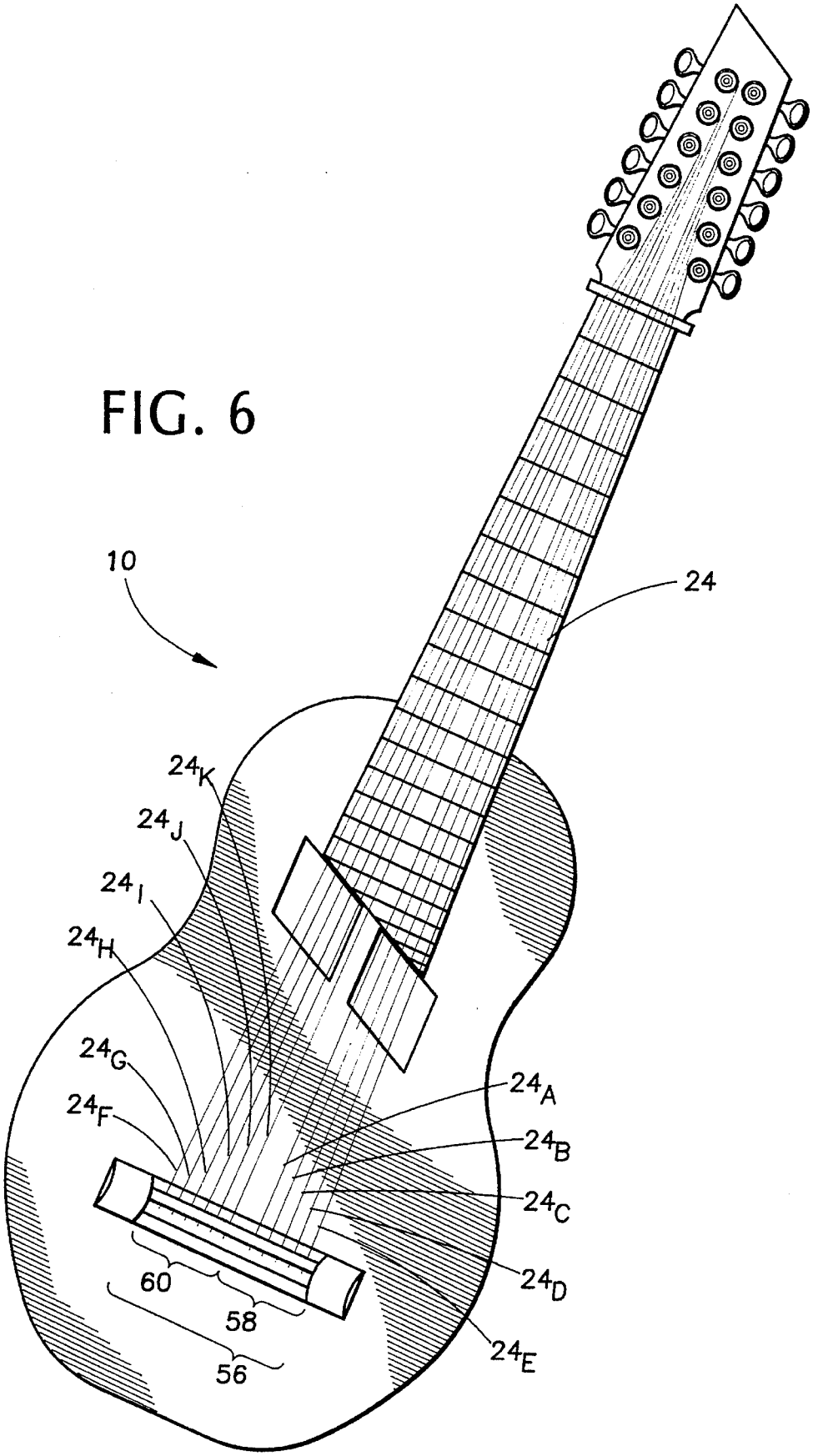
FIG. 6 is a top plan view of the musical instrument strung with the first replaceable string configuration.
Figure 7:
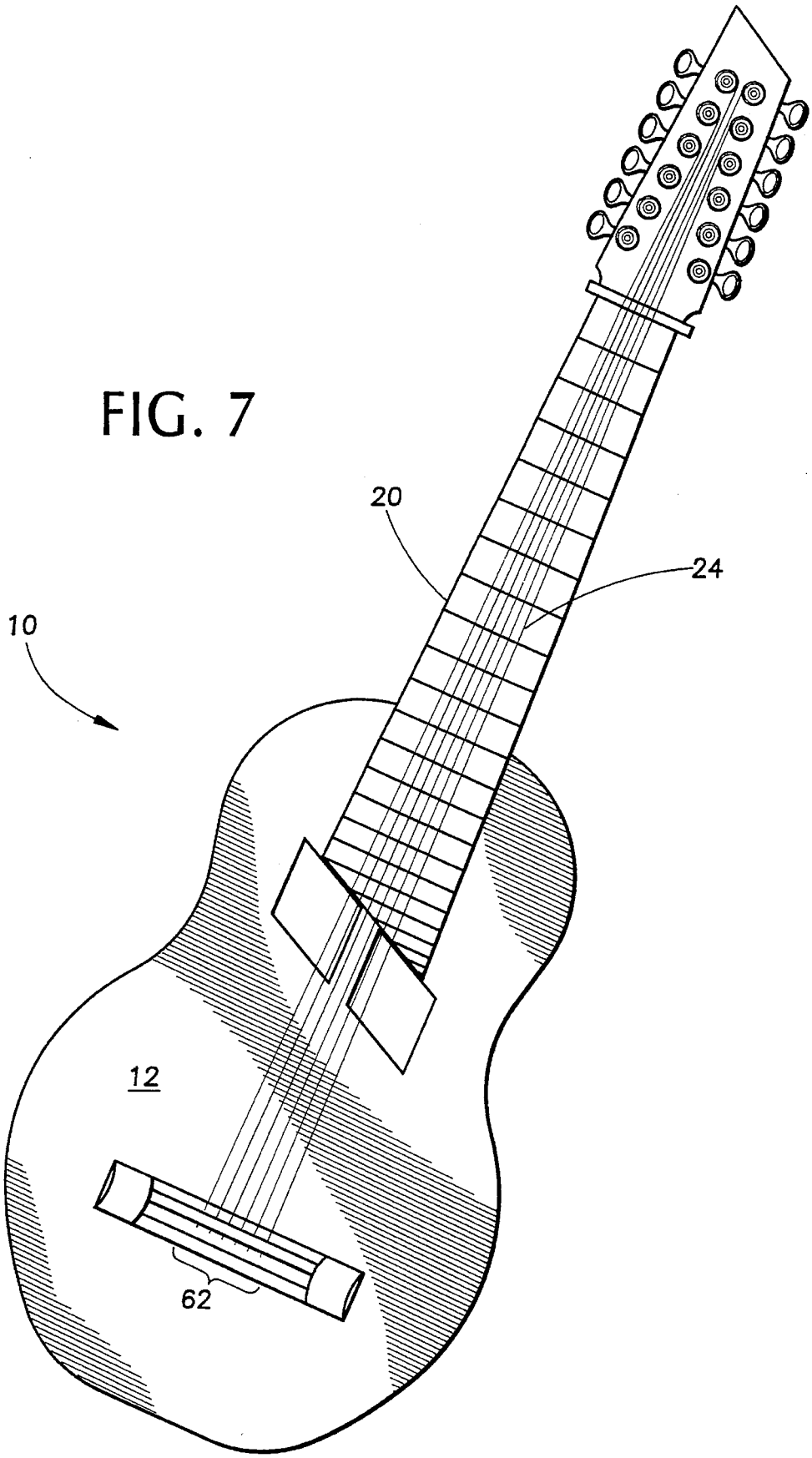
FIG. 7 is a top plan view of the musical instrument strung with the second replaceable string configuration.

Referring to the attached drawings, FIGS. 1 and 2 show the new musical instrument generally at 10. The musical instrument 10 features a hollow, resonating body 12. The hollow, resonating body 12 is preferably constructed of wood, although it is fully within the scope of the invention to use any other suitable material. There is a first sounding port 14 and a second sounding port 16 that extend through an upper surface 18 of said hollow, resonating body 12. Preferably, the first sounding port 14 and the second sounding port 16 are substantially parallelogram in shape, although it is anticipated that other shapes may be used to vary the aesthetic and tonal aspects of the invention.

The invention 10 also teaches an elongate neck 20 that is fixedly attached on a proximate end 21 of the elongate neck 20 to the upper surface 18 of resonating body 12 by any conventional means, including but not limited to glue.

Elongate neck 20 is preferably constructed of wood, although other materials may be used. A plurality of frets 22 are fixedly attached to the elongate neck 20. The plurality of frets 22 are disposed substantially orthogonal to a longitudinal axis $L_N$ of elongate neck 20. The plurality of frets 22 are positioned on the elongate neck 20 so as to provide indicia to the musician of half-step tone progressions. The plurality of frets 22 are preferably constructed of metal.

The instrument teaches a plurality of strings 24. The strings may be of metal, nylon, or any other material found acceptable by the music industry. Similarly, the diameter of an individual string may be any diameter that is found to produce appropriate sounds when attached to the instrument in the manner described below. Each string 24 has a first end 26 and a second end 28 as shown in FIG. 3 of the Drawings.

The invention 10 teaches a means for attaching 30 which attaches the first end 26 of the strings 24 to said resonating body 12. The means for attaching 30, shown in FIG. 4, is preferably a bridge member 32 that is fixedly attached to the resonating body 12. In the preferred embodiment of the invention, the bridge member 32 is substantially rectangular and is constructed of wood, metal or a combination of both. The bridge member 32 is preferably constructed with thirty throughbored string apertures 36 and thirty string attachment points 38. The thirty string attachment points 38 are preferably castellated screws, although any conventional means of attaching strings may be used. It is clearly contemplated that the number of string apertures 36 and string attachment points 38 may be varied.

The first end 26 of each string 24 is releasably attachable to bridge member 32. A musician simply threads first end 26 through one of the thirty string apertures 36, then attaches first end 26 to one of the thirty string attachment points 38. Each string 24 is attachable to bridge member 32 in at least one of four replaceable string configurations. The replaceable string configurations are more fully described below.

Turning now to the elongate neck 20 with frets 22, there is a means of spacing 40 said plurality of strings 24 fixedly attached near a distal end 42 of the elongate neck 20. This means of spacing 40, shown best in FIG. 5, comprises a substantially rectangular bone bar 42 having eighteen string channels 46.

There is a means for attaching 48 that attaches the second end 28 of said plurality of strings 24. The means for attaching 48 is fixedly attached to the distal end 42 of elongate neck 20. The means for attaching 48 is best illustrated in FIGS. 1 and 2. In addition to serving as a means for attaching the strings 24, means for attaching 48 also serves as a means for tuning 50 that selectively tunes the strings 24. The means for tuning 50 comprises a string tuning peg mounting member 52 having a plurality of string tuning pegs 54 rotatably mounted therein. Each string 24 may be removably attached to a string tuning peg 54 in at least one of four replaceable string configurations. A musician may selectively vary the tension of the attached string 24 by rotating the string tuning peg 54, which causes string 24 to wind or unwind from the string tuning peg 54.

Turning now to the four replaceable string configurations illustrated in FIGS. 6, 7, 8, and 9, each of the four configurations shares several common features. In each string configuration the first end 26 of each string 24 is removably attached to a string attachment point 38 in the manner described above. The second end 28 of each string 24 is removably attached to the string tuning pegs 54. Each attached string 24 passes through one of the string channels 46. Once attached to a string tuning peg 54 and a string attachment point 38, the string 24 may be tuned to the desired pitch using the method described above.

While the four replaceable string configurations share several common features, each is distinct from the others. The first replaceable string configuration 56, shown in FIG. 6, consists of eleven strings 24*a*–24*k*.

Figure 10:
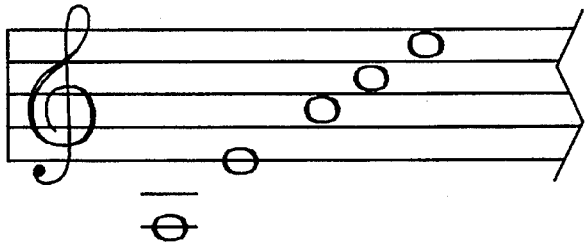
FIG. 10 is a diagram of musical notation depicting the notes to which the first portion in the first replaceable string configuration are tuned.

First replaceable string configuration 56 teaches a first portion 58 consisting of five strings 24*a*, 24*b*, 24*c*, 24*d* and 24*e*. First portion 58 is tuned to an A-minor chord as shown in FIG. 10. Applicant anticipates that A-minor chords in other octaves may be substituted without departing from the spirit of his invention.

Figure 11:
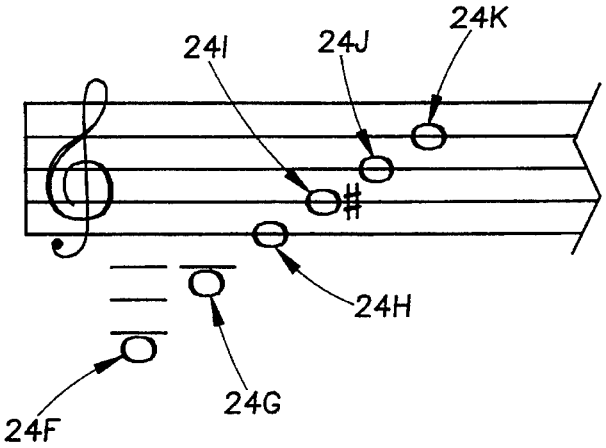
FIG. 11 is a diagram of musical notation depicting the notes to which the strings in the second portion of the first replaceable string configuration are tuned.

First replaceable string configuration 56 also teaches a second portion 60. Second portion 60 consists of six strings 24, numbered in FIG. 6 as 24*f*, 24*g*, 24*h*, 24*i*, 24*j* and 24*k*. Strings 24*f*, 24*g*, 24*h*, 24*i*, and 24*j* are tuned to an E-major chord, while string 24*k* is tuned to D, thus forming an E7 chord (See FIG. 11). Applicant anticipates that second portion 60 may be tuned in octaves other than the octave depicted in FIG. 11.

First replaceable string configuration 56 is unique in that a musician playing the invention is able to play a plurality of different chords using only one finger to produce the desired chord. The finger is placed across all of the strings in either the first portion 58 or the second portion 60. To illustrate this unique feature of the present invention, assume that a musician has strung the invention in accordance with the first replaceable string configuration 56. Further assume that the musician has properly tuned the strings using string tuning pegs 54. At this point the musician can play three base chords. By striking strings 24*a* –24*e* of first portion 59 in the manner described above, the musician can play an A-minor chord. By striking strings 24*f* –24*j* of the second portion 60, the musician can play an E-major chord. The musician may also play an E7 chord by playing the E-Major chord as above and adding string 24*k*. Note that after playing the E7 chord, the musician may resolve the chord by striking the E-major chord in the manner described above.

Playing chords different than those described above is a simple matter. If the desired chord is in a minor key, it is played using first portion 58. If the desired chord is in a major key, it is played using strings 24*f* –24*j* of second portion 60. If the desired chord is a major seventh, it is played using strings 24*f* 24*k*.

Figure 12:
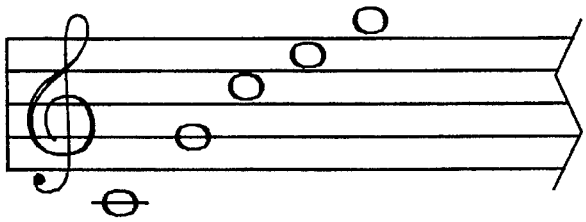
FIG. 12 is a diagram of musical notation depicting the notes of a C-Major chord produced by the second portion of the first replaceable string portion.

After deciding which portion of the first replaceable string configuration 54 to use, the musician determines how many half steps are required to move from the base chord to the desired chord. The musician then moves finger 100 inwardly along the elongate neck 20 from the distal end 42 to the fret 22 that corresponds to the desired number of half steps. For example, assume that a musician wishes to play a C-Major chord. Because a major chord is desired, the chord is played using strings 24*f* –24*j* of second portion 60. A C-major chord is separated from an E-Major chord by 8 half steps. Because each fret 22 represents a half-step increase in tone, the musician places his finger on the eighth fret 22*a* of the plurality of frets 22. When the musician strikes strings 24*f* –24*j*, they will produce the notes shown in FIG. 12, namely C, E, and G. Playing other chords is also accomplished in this manner, with the musician simply changing between first portion 58, second portion 60, and the plurality of frets 22.

In addition to first replaceable string configuration 56, the present invention also teaches a second replaceable string configuration 62. Second replaceable string configuration 62, shown in FIG. 7, consists of six strings 24 attached on a first end 24 to bridge member 32, on a second end 26 to string tuning pegs 54 and passing through string channels 46 of bone bar 42. The six strings 22 of second replaceable string configuration 62 are tuned to allow a user to play the musical instrument as a six string guitar.

Figure 8:
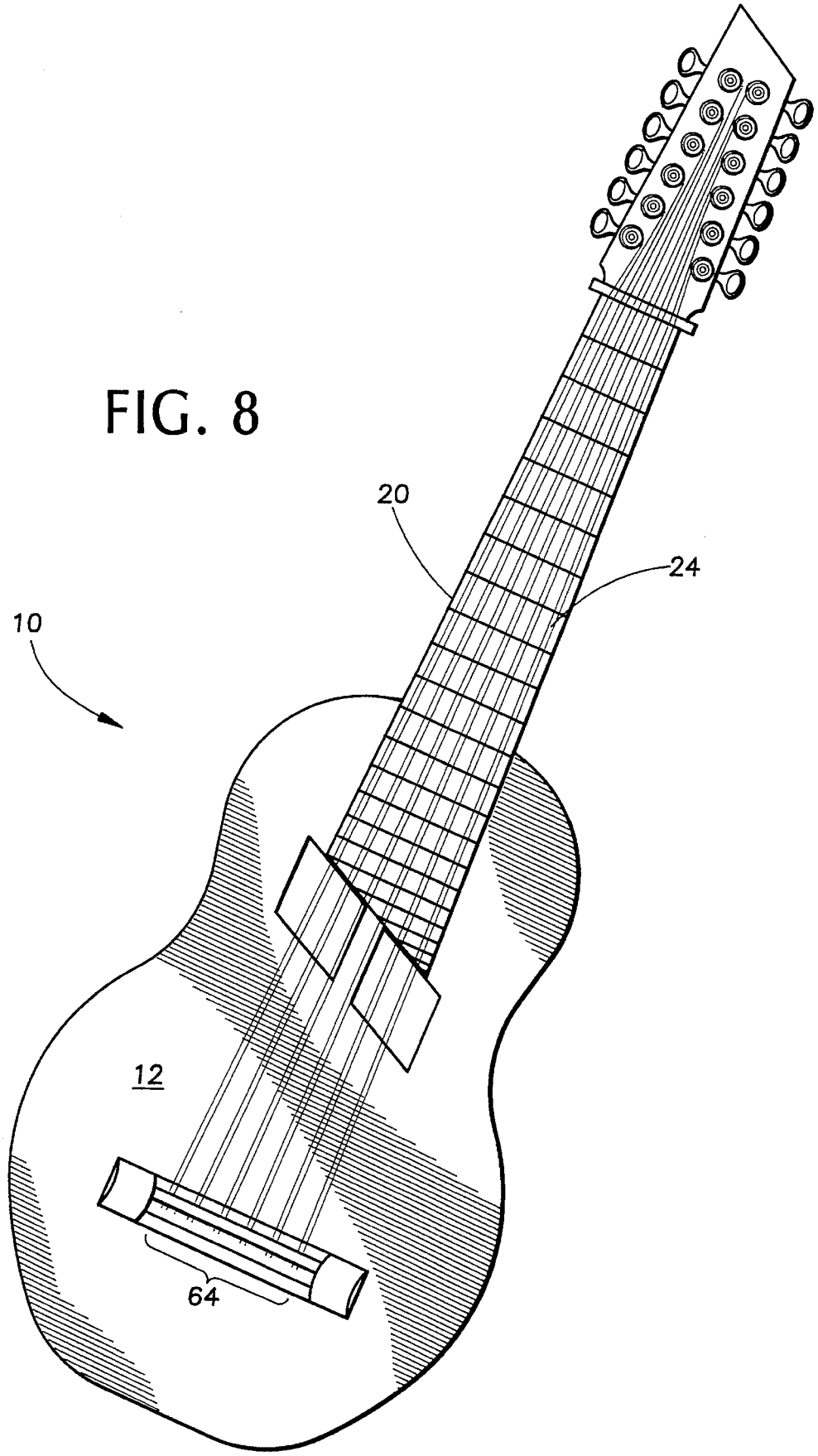
FIG. 8 is a top plan view of the musical instrument strung with the third replaceable string configuration.

Third replaceable string configuration 64, shown in FIG. 8, comprises twelve strings attached on first end 24 to bridge member 32 and on second end 26 to string tuning pegs 54, passing through string channels 46 of bone bar 42. The twelve strings 22 of the third replaceable string configuration 64 are tuned to allow a user to play the musical instrument as a twelve string guitar.

Figure 9:
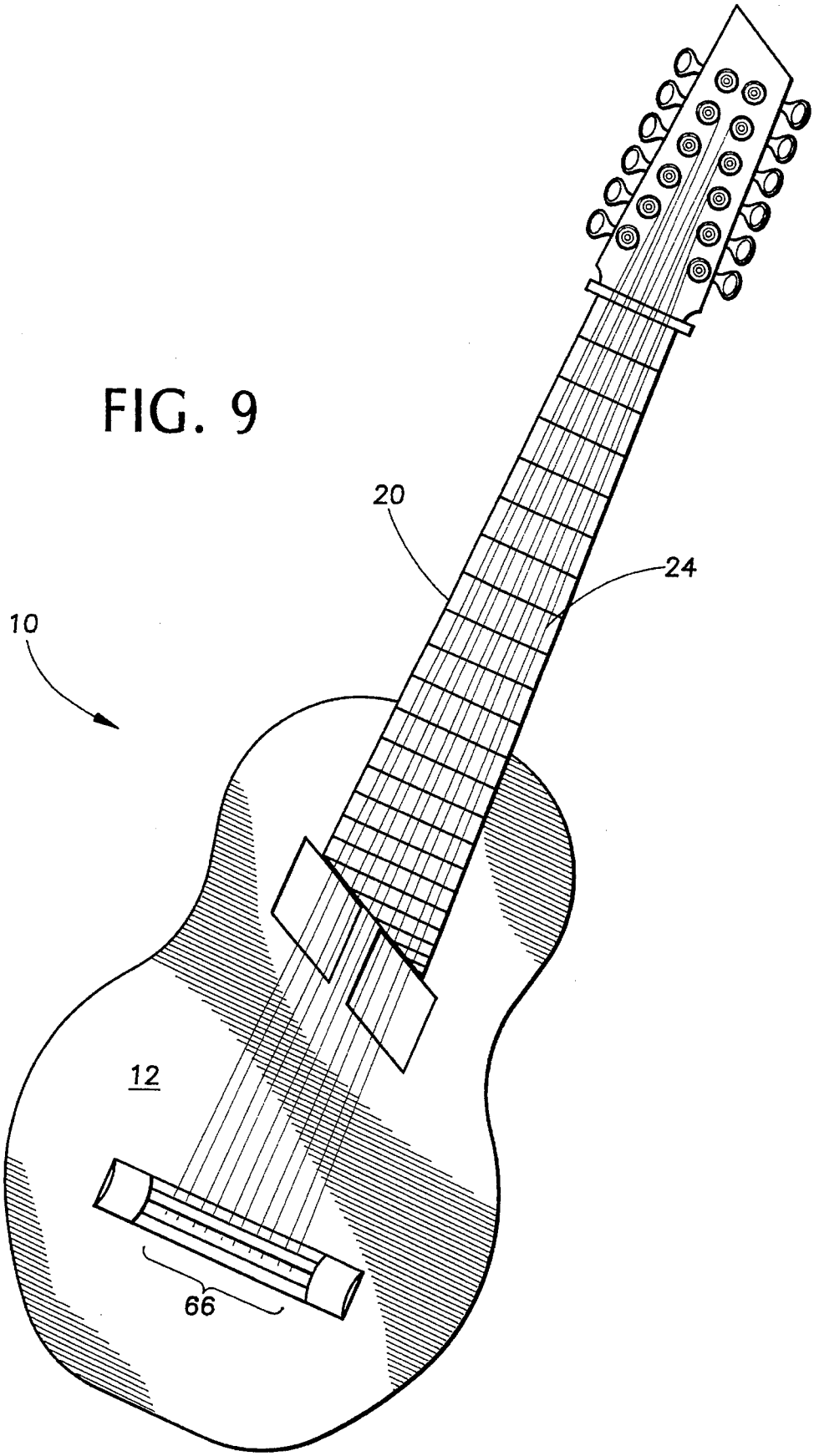
FIG. 9 is a top plan view of the musical instrument strung with the fourth replaceable string configuration.

Fourth replaceable string configuration 66, shown in FIG. 9, comprises ten strings attached on first end 24 to bridge member 32 and on second end 26 to string tuning pegs 54, passing through string channels 46 of bone bar 42. The ten strings 22 of the fourth replaceable string configuration 66 are tuned to allow a user to play the musical instrument as a Puerto Rican ten string guitar, commonly referred to as a Cuatro.

It is anticipated that various substitutions and changes other than those described above may be made without departing from the letter and spirit of the invention. In particular, the shape of the resonating body 12 and the length and shape of elongate neck 20 may be varied according to the needs of a particular musician.

What is claimed is:

1. A musical instrument comprising;

a resonating body;

a neck fixedly attached to said resonating body;

a plurality of strings;

each string in said plurality of strings comprising a first end and a second end;

a means for attaching the first end of each said string in said plurality of strings to said resonating body, said means for attaching the first end fixedly attached to an upper surface of said resonating body;

a means for spacing said plurality of strings fixedly attached near a distal end of the neck;

a means for attaching the second end of each said string in said plurality of strings to said neck, said means for attaching the second end fixedly attached to the distal end of the neck;

said means for attaching the second end further comprising a means for selectively tuning each attached string;

the first end of each string in said plurality of strings is releasably attachable to said means for attaching the first end in at least one of four replaceable string configurations;

the second end of each string in said plurality of string is releasably attachable to said means for attaching the second end in at least one of four replaceable string configurations;

a first replaceable string configuration of said four replaceable string configurations comprising:

a first portion and a second portion;

said first portion comprising five strings tuned to an open A-minor chord;

said second portion comprising six strings;

five strings of said second portion tuned to an open E-major chord;

one string of said second portion tuned so as to produce an E7 chord; and said first string configuration allowing a user to play a plurality of chords using one finger;

a second replaceable string configuration of said four replaceable string configurations comprising six strings tuned to allow a user to play the musical instrument as a six string guitar;

a third replaceable string configuration of said four replaceable string configurations comprising twelve strings tuned to allow a user to play the musical instrument as a twelve string guitar; and a fourth replaceable string configuration of said four replaceable string configurations comprising ten strings tuned to allow a user to play the musical instrument as a Cuatro.

2. A musical instrument as described in claim 1 wherein said resonating body further comprises a first sounding port and a second sounding port extending through said upper surface of said resonating body.

3. A musical instrument as described in claim 1; wherein said neck further comprises a plurality of frets disposed substantially orthogonal to a longitudinal axis of said neck.

4. A stringed musical instrument as described in claim 1, wherein said first means of attaching said strings to said resonating body comprises:

a bridge member fixedly attached to said resonating body;

a plurality of throughbored string receiving apertures in said bridge member; and a plurality of string attachment points disposed on said bridge.

5. A musical instrument as described in claim 1 wherein said means for spacing said plurality of strings further comprises:

a bone bar member; and a plurality of string channels in said bone bar member.

6. A musical instrument as described in claim 1, wherein said means for tuning said plurality of strings further comprises:

a string tuning peg mounting member fixedly attached to a distal end of the neck; and a plurality of string tuning pegs rotatably mounted in said string tuning peg mounting member.

7. A musical instrument comprising;

a hollow resonating body;

a first sounding port and a second sounding port extending through an upper surface of said hollow resonating body;

said first sounding port and said second sounding port are substantially parallelogram shaped;

an elongate neck fixedly attached to the upper surface of said resonating body;

a plurality of frets fixedly attached to said elongate neck;

said plurality of frets disposed substantially orthogonal to a longitudinal axis of said elongate neck;

said plurality of frets spaced on said elongate neck so as to provide indicia of half-step tone progressions;

a plurality of strings;

each string in said plurality of strings further comprising a first end and a second end;

a means for attaching the first end of the strings to said resonating body, said means for attaching the first end comprising:

a bridge member fixedly attached to said resonating body;

said bridge member further comprising a substantially rectangular member;

thirty throughbored string apertures in said substantially rectangular member;

thirty string attachment points disposed on said bridge;

the first end of each string in said plurality of strings is releasably attachable to said bridge member in at least one of four replaceable string configurations;

a means of spacing said plurality of strings, said means of spacing fixedly attached near a distal end of the elongate neck, comprising:

a bone bar member further comprising:

a substantially rectangular member;

eighteen string channels disposed in said substantially rectangular member;

a means for attaching the second end of said plurality of strings, said means for attaching the second end fixedly attached to a distal end of said elongate neck;

said means for attaching the second end further comprising a means for tuning said plurality of strings;

said means for tuning further comprising;

a string tuning peg mounting member fixedly attached on a distal end of the elongate neck;

a plurality of string tuning pegs rotatably mounted in said string tuning peg mounting member;

the second end of each string in said plurality of strings removably attached to said plurality of string tuning pegs in at least one of four replaceable string configurations;

each string tuning peg of the plurality of tuning pegs capable of selectively varying the tension of the attached string when said string tuning peg is rotated;

a first replaceable string configuration of said four replaceable string configurations comprising:

a first portion and a second portion;

said first portion comprising five strings tuned to an open A-minor chord;

said second portion comprising six strings;

five strings of said second portion tuned to an open E-major chord;

one string of said second portion tuned so as to produce an E7 chord; and said first replaceable string configuration allowing a user to play a plurality of chords using one finger;

a second replaceable string configuration of said four replaceable string configurations comprising six strings tuned to allow a user to play the musical instrument as a six string guitar;

a third replaceable string configuration of said four replaceable string configurations comprising twelve strings tuned to allow a user to play the musical instrument as a twelve string guitar; and a fourth string configuration of said four replaceable string configurations comprising ten strings tuned to allow a user to play the musical instrument as a Cuatro.

* * * * *